US011392051B2

(12) United States Patent
Higuchi et al.

(10) Patent No.: US 11,392,051 B2
(45) Date of Patent: Jul. 19, 2022

(54) IMAGE FORMING METHOD, IMAGE FORMING DEVICE AND SET

(71) Applicant: BROTHER KOGYO KABUSHIKI KAISHA, Nagoya (JP)

(72) Inventors: Takayuki Higuchi, Gifu-ken (JP); Tatsuya Ezaka, Kariya (JP); Norihiro Hirai, Wakayama (JP); Hisakazu Tajima, Wakayama (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/903,607

(22) Filed: Jun. 17, 2020

(65) Prior Publication Data

US 2020/0310272 A1 Oct. 1, 2020

Related U.S. Application Data

(63) Continuation of application No. PCT/JP2018/046759, filed on Dec. 19, 2018.

(30) Foreign Application Priority Data

Dec. 20, 2017 (JP) ..... JP2017-244174

(51) Int. Cl.
*G03G 15/00* (2006.01)
*G03G 9/087* (2006.01)
(Continued)

(52) U.S. Cl.
CPC ..... *G03G 9/08797* (2013.01); *G03G 9/08728* (2013.01); *G03G 9/08733* (2013.01);
(Continued)

(58) Field of Classification Search
CPC ..... G03G 15/2096; G03G 11/00
See application file for complete search history.

(56) References Cited

U.S. PATENT DOCUMENTS

2006/0115762 A1 6/2006 Katano et al.
2011/0151370 A1 6/2011 Shitara et al.
(Continued)

FOREIGN PATENT DOCUMENTS

EP 1 653 294 A2 5/2006
EP 2 065 757 A1 6/2009
(Continued)

OTHER PUBLICATIONS

English language machine translation of JP 2011150285. (Year: 2011).*
(Continued)

*Primary Examiner* — Mark A Chapman
(74) *Attorney, Agent, or Firm* — Merchant & Gould P.C.

(57) ABSTRACT

An image forming method includes: forming a toner image on a print medium by using a toner including toner particles having a binder resin which contains a condensate of straight-chain diol having 2 to 6 carbon atoms, an alkylene oxide adduct of bisphenol A and polyvalent carboxylic acid; and applying, to the toner image, a fixing solution containing an ester-based softening agent having a boiling point of not less than 180° C. so as to fix the toner image to the print medium.

17 Claims, 2 Drawing Sheets

(51) Int. Cl.
*G03G 15/20* (2006.01)
*G03G 11/00* (2006.01)

(52) U.S. Cl.
CPC ..... *G03G 9/08753* (2013.01); *G03G 9/08755* (2013.01); *G03G 11/00* (2013.01); *G03G 15/20* (2013.01); *G03G 15/2064* (2013.01); *G03G 15/2096* (2013.01)

(56) References Cited

U.S. PATENT DOCUMENTS

| | | | | |
|---|---|---|---|---|
| 2012/0135342 | A1* | 5/2012 | Katano ..... | G03G 15/2096 430/104 |
| 2013/0202336 | A1 | 8/2013 | Fujisaki et al. | |
| 2013/0244166 | A1* | 9/2013 | Yamazaki ..... | G03G 9/08755 430/109.1 |
| 2013/0259550 | A1 | 10/2013 | Shibata et al. | |
| 2018/0217543 | A1 | 8/2018 | Kakigahara et al. | |

FOREIGN PATENT DOCUMENTS

| | | | |
|---|---|---|---|
| JP | 2006-133306 | A1 | 5/2006 |
| JP | 2011-128555 | A | 6/2011 |
| JP | 2011-150285 | A | 8/2011 |
| JP | 2011-215563 | A | 10/2011 |
| JP | 2012-150467 | A | 8/2012 |
| JP | 2013-160828 | A | 8/2013 |
| JP | 2013-205684 | A | 10/2013 |
| JP | 2013-231950 | A | 11/2013 |
| JP | 2013-246377 | A | 12/2013 |
| JP | 2014-186189 | A | 10/2014 |
| JP | 2017068098 | A | 4/2017 |

OTHER PUBLICATIONS

Extended European Search Report issued in corresponding European Patent Application No. 18891805.6, dated Jul. 16, 2021.
Written Opinion issued in corresponding International Patent Application No. PCT/JP2018/046759, dated Mar. 5, 2019.
International Search Report issued in corresponding International Patent Application No. PCT/JP2018/046759, dated Mar. 5, 2019.
Notice of Reasons for Refusal issued in corresponding Japanese Patent Application No. 2017-244174, dated Nov. 9, 2021.
Office Action (Notice of Reasons for Refusal) issued in corresponding Japanese Patent Application No. 2017-244174, dated May 10, 2022.

* cited by examiner

IMAGE FORMING METHOD, IMAGE FORMING DEVICE AND SET

CROSS REFERENCE TO RELATED APPLICATION

This application is a Continuation Application of International Application No. PCT/JP2018/046759 which was filed on Dec. 19, 2018 claiming the conventional priority of Japanese patent Application No. 2017-244174 filed on Dec. 20, 2017.

BACKGROUND OF THE INVENTION

Field of the Invention

The present invention relates to an image forming method, an image forming apparatus and a set usable for the image forming method.

Description of the Related Art

Conventionally, there is known an image forming apparatus including a toner image forming section and a fixing section (see Patent Literature 1: Japanese Patent Application Laid-open No. 2017-68098 corresponding to US 2018/0217543). The toner image forming section forms a toner image in a print medium. The toner image forming section has: a photosensitive drum; a charging section; an exposing section; a developing section; and a transfer roller. The charging section charges a surface of the photosensitive drum. The exposing section exposes the surface of the photosensitive drum. The developing section has a toner accommodating section accommodating a toner and a developing roller making contact with the photosensitive drum. The transfer roller makes contact with the photosensitive drum. The fixing section applies a fixing solution to the toner image so as to fix the toner image to the print medium.

However, in Patent Literature 1 as mentioned above, in a case that an organic solvent having a high volatility is used as the fixing solution, there is such an inconvenience that a strong odor of the organic solvent is generated.

Further, in a case that an organic solvent having a low volatility is used as the fixing solution, there is such an inconvenience that the toner is hard to cure after being softened by the organic solvent; and further that, in a case that another print medium is superposed on a print medium on which the toner image is formed and to which the fixing solution is applied, the toner which is still softened is transferred to the another print medium.

Therefore, an object of the present teaching is to provide an image forming method, an image forming apparatus each of which is capable of forming a toner image while suppressing any generation of strong odor of an organic solvent, and is capable of suppressing any transfer of the toner image, formed on a print medium, onto another print medium in a case that the another print medium is overlaid on the print medium in which the toner image is formed and to which the fixing solution is applied.

SUMMARY OF THE INVENTION

According to a first aspect, there is provided an image forming method including:

forming a toner image on a print medium by using a toner including toner particles having a binder resin which contains a condensate of straight-chain diol having 2 to 6 carbon atoms, an alkylene oxide adduct of bisphenol A and polyvalent carboxylic acid;

applying, to the toner image, a fixing solution containing an ester-based softening agent having a boiling point of not less than 180° C. so as to fix the toner image to the print medium.

According to a second aspect, there is provided an image forming apparatus including:

a toner image forming section configured to form a toner image in a print medium; and a fixing section accommodating a fixing solution and configured to apply the fixing solution to the toner image so as to fix the toner image to the print medium, wherein the toner image forming section has: a photosensitive drum; a charging section configured to charge a surface of the photosensitive drum; an exposing section configured to expose the surface of the photosensitive drum so as to form an electrostatic latent image on the surface of the photosensitive drum; a developing section configured to supply a toner to the surface of the photosensitive drum so as to develop the electrostatic latent image and to form the toner image; and a transfer roller configured to make contact with the photosensitive drum and to transfer the toner image from the photosensitive drum to the print medium, the developing section having a toner accommodating part accommodating the toner therein, and a developing roller configured to make contact with the photosensitive drum so as to supply the toner accommodated in the toner accommodating part to the surface of the photosensitive drum;

the toner includes toner particles having a binder resin which contains a condensate of straight chain diol having 2 to 6 carbon atoms, an alkylene oxide adduct of bisphenol A and polyvalent carboxylic acid; and the fixing solution contains an ester-based softening agent having a boiling point of not less than 180° C.

According to a third aspect, there is provided a set usable for an image forming method, the set including:

a toner including toner particles having a binder resin which contains a condensate of straight chain diol having 2 to 6 carbon atoms, an alkylene oxide adduct of bisphenol A and polyvalent carboxylic acid; and an ester-based softening agent having a boiling point of not less than 180° C.

DESCRIPTION OF THE PREFERRED EMBODIMENT

The image forming method of the embodiment includes: a toner image forming step; and a fixing step.

The toner image forming step is a step of forming a toner image on a print medium using a toner. The toner contains toner particles. The toner particles contain a binder resin. The binder resin contains a condensate of straight chain diol having 2 to 6 carbon atoms, an alkylene oxide adduct of bisphenol A and polyvalent carboxylic acid.

The fixing step is a step of applying a fixing solution to the toner image to fix the toner image to the print medium. The fixing solution contains an ester-based softening agent. The ester-based softening agent is capable of softening the binder resin. The boiling point of the ester-based softening agent is not less than 180° C.

According to such a method, the binder resin is softened with the ester-based softening agent having a boiling point of not less than 180° C.

Therefore, it is possible to suppress volatilization of the organic solvent and to suppress generation of the strong odor of the organic solvent.

Further, the binder resin also contains the condensate of the straight chain diol having 2 to 6 carbon atoms, the alkylene oxide adduct of bisphenol A and the polyvalent carboxylic acid.

Therefore, the binder resin is softened with the ester-based softening agent of which boiling point is not less than 180° C., and is cured in a state that the binder resin contains the ester-based softening agent.

As a result, even in such a case that a toner image is formed in a certain print medium and the fixing solution is applied to the certain print medium, and that another print medium is overlaid on the certain print medium, it is possible to suppress any transfer of the toner on to the another print medium.

1. Schematic of Image Forming Method and Image Forming Apparatus

The schematic or overview of an image forming method and an image forming apparatus will be explained.

Figure 3:
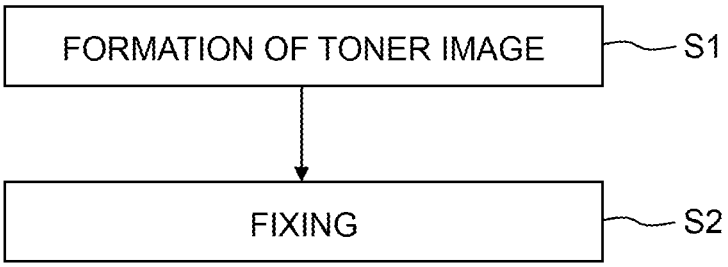
FIG. 3 is a flow chart explaining an image forming method.

As depicted in FIG. 3, the image forming method includes a toner image forming step (step S1) and a fixing step (step S2). The toner image forming step is a step of forming a toner image on a print medium by using a toner. The fixing step is a step of applying a fixing solution to the toner image to fix the toner image to the print medium. Note that in the fixing step, since the toner image is fixed to the print medium by using the fixing solution, it is not necessary to adhere the toner image onto the print medium through thermal pressurization.

Figure 1:
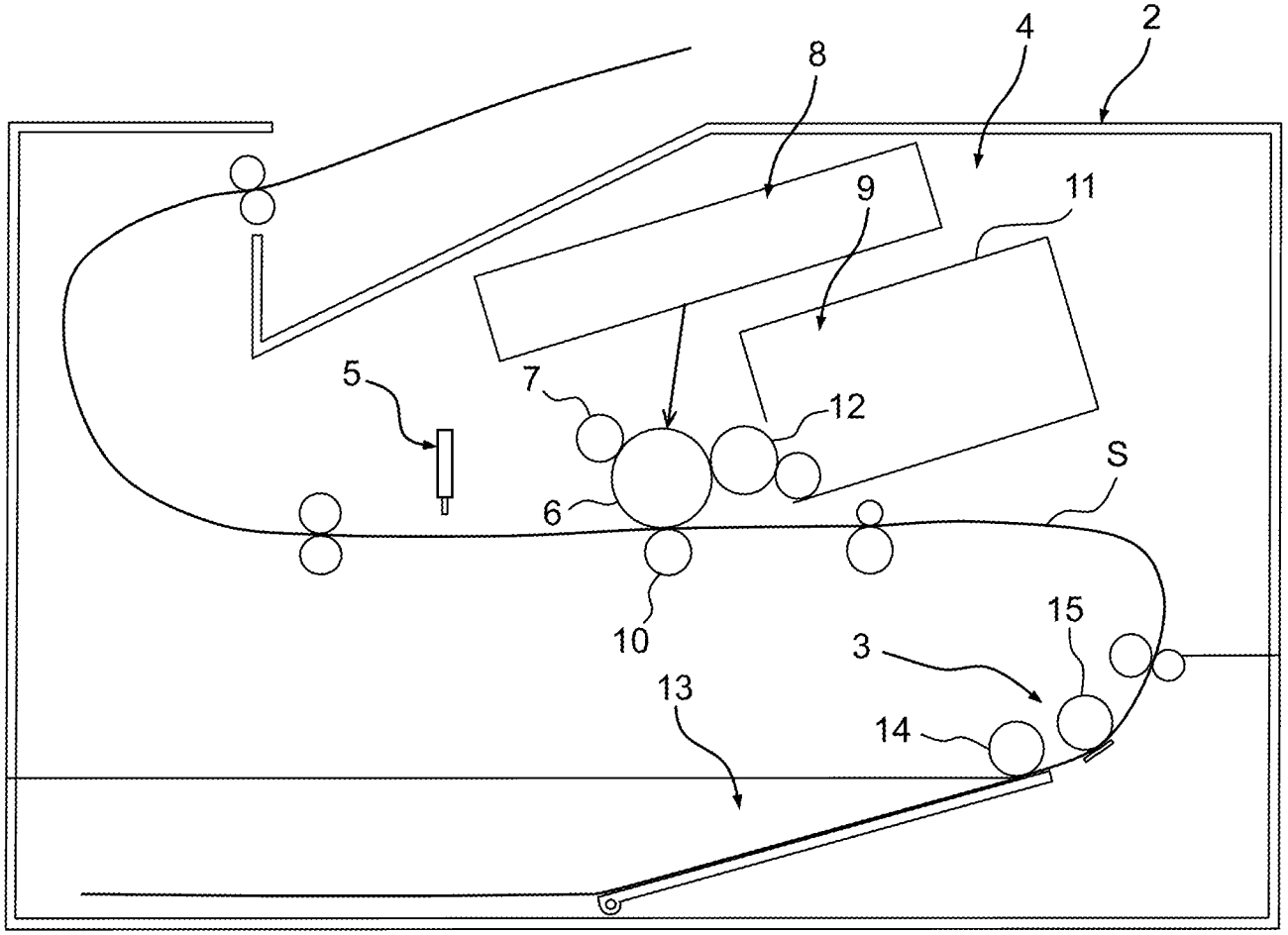
FIG. 1 is a schematic view of an image forming apparatus.

The image forming apparatus depicted in FIG. 1 is capable of executing the image forming method. An image forming apparatus 1 includes a body casing 2, a sheet feeding section 3, a toner image forming section 4, and a fixing section 5.

1.1: Body Casing

The body casing 2 constructs the exterior of the image forming apparatus 1. The body casing 2 accommodates the sheet feeding section 3, the toner image forming section 4, and the fixing section 5.

1.2: Sheet Feeding Section

The sheet feeding section 3 is configured to supply or feed a print medium S to the toner image forming section 4. Specifically, the sheet feeding section 3 is configured to convey the print medium S towards a photosensitive drum 6 of the toner image forming section 4. The toner image forming section 4 will be described later on. The sheet feeding section 3 includes a paper feed tray 13, a pick-up roller 14, and a paper feed roller 15. The paper feed tray 13 is configured to accommodate the print medium S. The print medium S is, for example, printing paper (printing paper sheet). The pick-up roller 14 is configured to convey the print medium S in the paper feed tray 13 towards the paper feed roller 15. The paper feed roller 15 is configured to convey the print medium S fed from the pick-up roller 14 towards the photosensitive drum 6.

1.3: Toner Image Forming Section

The toner image forming section 4 is configured to use the toner to form the toner image in the print medium S. Namely, the image forming apparatus 1 is capable of executing the toner image forming step. The toner image forming section 4 has the photosensitive drum 6, a charging section 7, an exposing section 8, a developing section 9, and a transfer roller 10.

The photosensitive drum 6 has a cylindrical shape. The photosensitive drum 6 is rotatable about the central axial line of the photosensitive drum 6.

The charging section 7 is configured to charge a surface of the photosensitive drum 6. Specifically, the charging section 7 is a charging roller. The charging section 7 may be a scorotoron type charging device. In a case that the charging section 7 is the charging roller, the charging section 7 makes contact with the surface of the photosensitive drum 6. In a case that the charging section 7 is the scorotoron type charging device, the charging section 7 is positioned to have a spacing distance with respect to the surface of the photosensitive drum 6.

The exposing section 8 is configured to expose the surface of the photosensitive drum 6. Specifically, the exposing section 8 is configured to expose the surface, of the photosensitive drum 6, which is charged by the charging section 7. As a result, an electrostatic latent image is formed on the surface of the photosensitive drum 6. Specifically, the exposing section 8 is a laser scan unit. Note that the exposing section 8 may be an LED array.

The developing section 9 is configured to provide the toner to the surface of the photosensitive drum 6. This develops the electrostatic latent image and forms a toner image on the surface of the photosensitive drum 6. The developing section 9 has a toner accommodating section 11 and a developing roller 12. The toner accommodating section 11 accommodates the toner. The developing roller 12 is configured to deliver or feed the toner in the inside of the toner accommodating section 11 to the surface of the photosensitive drum 6. The developing roller 12 makes contact with the photosensitive drum 6. Note that the developing roller 12 does not need to make contact with the photosensitive drum 6.

The developing section 9 may be configured as one process unit, together with the photosensitive drum 6 and the charging section 7. The process unit may be attachable to the body casing 2.

Further, the developing section 9 may also be a developing cartridge attachable to a drum unit having the photosensitive drum 6 and the charging section 7. The drum unit may also be attachable to the body casing 2.

The developing section 9 may also be provided with: a developer including the developing roller 12; and a toner cartridge attachable to the developer. In such a case, the toner cartridge is provided with the toner accommodating section 11. Further, the developer may be provided on the drum unit. The developer may be attachable to the drum unit.

The transfer roller 10 is configured to transfer the toner image from the photosensitive drum 6 to the print medium S. Thus, the toner image is formed in the print medium S. The transfer roller 10 make contact with the photosensitive drum 6. Note that the transfer roller 10 does not need to make contact with the photosensitive drum 6.

1.4: Fixing Section

The fixing section 5 is configured to accommodate the fixing solution, to apply the fixing solution to the toner image, and to fix the toner image to the print medium S. Namely, the image forming apparatus 1 is capable of executing the fixing step. The fixing section 5 applies the fixing solution to the toner image by spraying the fixing solution towards the toner image, without making any contact with the toner image. Note that the fixing section 5 may include a fixing roller coated with the fixing solution. The fixing roller makes contact with the toner image and applies the fixing solution to the toner image. The print medium S on which the toner image is fixed is discharged onto the upper surface of the body casing 2. In this embodiment, it is allowable that the toner image is not subjected to the adhesion to the print medium S through thermal pressurization. For this reason, it is allowable that the fixing section 5 does not have any thermal fixing device.

2. Details of Toner

Next, the toner will be explained in detail.

The toner contains toner particles. The toner optionally contains an external additive.

2.1: Toner Particles

The toner particles contain a binder resin. The toner particles contain, as necessary, a colorant, a pigment dispersant, a mold releasing agent, a magnetic body and an electrostatic charge controlling agent.

2.1.1: Binder Resin

The binder resin is the base of the toner particles. The binder resin binds components contained in the toner particles. The binder resin is softened by the application of the fixing solution thereto: then, the binder resin is cured to be fixed (adhered) to the print medium. The binder resin contains a condensate of straight chain diol having 2 to 6 carbon atoms, an alkylene oxide adduct of bisphenol A and polyvalent carboxylic acid.

The binder resin may be substantially composed only of the condensate of straight chain diol having 2 to 6 carbon atoms, the alkylene oxide adduct of bisphenol A and the polyvalent carboxylic acid. The blending ratio of the condensate of the straight chain diols having 2 to 6 carbon atoms, the alkylene oxide adduct of bisphenol A and the polyvalent carboxylic acids is, for example, not less than 95% by mass, not less than 99% by mass, or 100% by mass, in the binder resin. Further, the binder resin may also be composed by mixing anther substance to the straight chain diol having 2 to 6 carbon atoms, the alkylene oxide adduct of bisphenol A and the polyvalent carboxylic acid. In a case that the binder resin is composed by mixing another substance with the condensate of the straight-chain diol having 2 to 6 carbon atoms, the alkylene oxide adduct of bisphenol A and the polyvalent carboxylic acid, the blending ratio of the condensate of the straight-chain diol having 2 to 6 carbon atoms, the alkylene oxide adduct of bisphenol A and the polyvalent carboxylic acid is, for example, not less than 1% by mass, preferably not less than 20% by mass, in the binder resin.

The straight chain diol having 2 to 6 carbon atoms is preferably a diol in which hydroxyl groups are attached, respectively, to the carbons at the both ends of the straight-carbon chain, namely, α,ω-aliphatic diol having 2 to 6 carbon atoms. The α,ω-aliphatic diol having 2 to 6 carbon atoms is exemplified, for example, by: 1,2-ethanediol, 1,3-propanediol, 1,4-butanediol, 1,5-pentanediol, and 1,6-hexanediol. Only one kind of the straight chain diol having 2 to 6 carbon atoms may be used singly or two or more kinds of the straight chain diol having 2 to 6 carbon atoms may be used in a mixed manner.

The straight chain diol is preferably 1,4-butanediol. In a case that the straight chain diol is 1,4-butanediol, it is possible to suppress any transfer of the toner on another print medium in such a case that the another print medium is overlaid on a print medium in which the toner image is formed and to which the fixing solution is applied.

The alkylene oxide adduct of bisphenol A is exemplified, for example, by: an ethylene oxide adduct of bisphenol A, a propylene oxide adduct of bisphenol A, etc. The addition molar number of alkylene oxide is, for example, not less than 2, and/or not more than 4. Only one kind of these alkylene oxide adducts of bisphenol A may be used singly, or two or more kinds of these alkylene oxide adducts of bisphenol may be used in a mixed manner.

The molar ratio of the alkylene oxide adduct of bisphenol A to the straight chain diol (the alkylene oxide adduct of bisphenol A/the straight chain diol) is, for example, not less than 50/50, preferably not less than 60/40, and, is for example, not more than 70/30. Namely, the molar ratio (the alkylene oxide adduct of bisphenol A/the straight chain diol) may be in a range of 50/50 to 70/30.

The polyvalent carboxylic acid is exemplified, for example, by: aromatic dicarboxylic acids such as phthalic acid (1,2-benzenedicarboxylic acid), isophthalic acid (1,3-benzenedicarboxylic acid), terephthalic acid (1,4-benzenedicarboxylic acid), and 1,4-naphthalenedicarboxylic acid, 2,6-naphthalenedicarboxylic acid, 4,4'-biphenyldicarboxylic acid, etc.; aliphatic dicarboxylic acids such as oxalic acid, malonic acid, succinic acid, glutaric acid, adipic acid, pimelic acid, suberic acid, azepinic acid, sebacic acid, etc.; and tricarboxylic acids such as trimellitic acid, trimesinic acid, etc. The polyvalent carboxylic acid is preferably the aromatic dicarboxylic acid. The aromatic dicarboxylic acid is preferably the terephthalic acid. Only one kind of these polyvalent carboxylic acids may be used singly, or two or more kinds of these polyvalent carboxylic acids may be used in a mixed manner.

The molar ratio of the polyvalent carboxylic acid to the total amount of the straight chain diol and alkylene oxide adduct of bisphenol A (the polyvalent carboxylic acid/the total amount of the straight-chain diol and the alkylene oxide adduct of bisphenol A) is, for example, not less than 85/100, and is, for example, not more than 90/100. Namely, the molar ratio (the polyvalent carboxylic acid/the total amount of the straight chain diol and the alkylene oxide adduct of bisphenol A) may be in a range of 85/100 to 90/100.

In order to produce the binder resin, the straight-chain diol, the alkylene oxide adduct of bisphenol A, the polyvalent carboxylic acid, and an esterification catalyst are charged into a reactor vessel and are heated, for example, at temperature of not less than 150° C. and not more than 250° C., for, for example, not less than 5 hours and not more than 10 hours. This allows the straight chain diol, the alkylene oxide adduct of bisphenol A, the polyvalent carboxylic acid to react to thereby allow a binder resin (condensate, ester) to be obtained.

Note that the esterification catalyst is exemplified, for example, by tin(II) 2-ethylhexanoate, etc.

2.1.2: Colorant

The colorant imparts a desired color to the toner particles. The colorant is dispersed in the binder resin.

The colorant is exemplified, for example, by: carbon black; an organic pigment which includes, for example, quinophthalone yellow, Hansa yellow, isoindolinone yellow, benzidine yellow, perinone orange, perinone red, perylene maroon, rhodamine 6G rake, quinacridone red, rose bengal, copper phthalocyanine blue, copper phthalocyanine green, diketo-pyrrolo-pyrrole-based pigment, etc.; inorganic pigment or metal powder which includes, for example, titanium white, titanium yellow, ultramarine, cobalt blue, red oxide, aluminum powder, bronze, etc.; oil-soluble or disperse dye which includes, for example, azo-based dye, quinophthalon-based dye, anthraquinone-based dye, xanthene-based dye, triphenylmethane-based dye, phthalocyanine-based dye, indophenol-based dye, indoaniline-based dye, etc.; a rosin-based dye which includes, for example, rosin, rosin-modified phenol, rosin-modified maleic resin, etc.; and dye and/or pigment processed by high-grade fatty acid or resin; and the like. The toner particles may contain only one type of the colorant, or may contain a plurality of colorants, depending on the desired color. Further, it is allowable that the toner particles do not contain the colorant.

The blending ratio of the colorant, with respect to 100 parts by mass of the binder resin, is, for example, not less than 2 parts by mass, preferably not less than 5 parts by mass; the blending ratio is, for example, not more than 20 parts by mass, preferably not more than 15 parts by mass.

2.1.3: Pigment Dispersant

The pigment dispersant improves the dispersibility of the colorant.

The blending ratio of the pigment dispersant, with respect to 100 parts by mass of the colorant, is, for example, not less than 0.1 parts by mass, preferably not less than 1 part by mass, for example, not more than 10 parts by mass, preferably not more than 5 parts by mass.

2.1.4: Electrostatic Charge Controlling Agent

The electrostatic charge controlling agent imparts the electrostatic property to the toner particles. The electrostatic property may be either the positive electrostatic charge or the negative electrostatic charge. The electrostatic charge controlling agent is exemplified, for example, by nigrosine-based dye, triphenylmethane-based dye, chromium-containing metal complex dye, molybdic acid chelate pigment, rhodamine-based dye, alkoxy-based amine, quaternary ammonium salt (including fluorine-modified quaternary ammonium salt), alkylamide, simple substance phosphorus or phosphorous compound, simple substance tungsten or tungsten compound, fluorine-based activator, metallic salt of salicylic acid, metallic salt of derivative of salicylic acid, and the like. Further, the electrostatic controlling agent is exemplified by copper phthalocyanine, perylene, quinacridone, azo-based pigment, and the like. In addition, the electrostatic charge controlling agent is exemplified, for example, also by a high polymer compound having a functional group such as sulfonic group, carboxyl group, quaternary ammonium salt, and the like.

The blending ratio of the electrostatic charge controlling agent, with respect to 100 parts by mass of the binder resin, is, for example, not less than 0.1 parts by mass, preferably not less than 1 part by mass; the blending ratio is, for example, not more than 20 parts by mass, preferably not more than 10 parts by mass.

2.1.5: Mold Releasing Agent

The mold releasing agent is exemplified, for example, by: polyolefin-based wax, long chain hydrocarbon-based wax, ester-based wax, etc.

The blending ratio of the mold releasing agent, with respect to 100 parts by mass of binder resin is, for example, not less than 0 parts by mass, preferably not less than 1 part by mass; the blending ratio is, for example, not more than 20 parts by mass, preferably not more than 10 parts by mass.

2.1.6: Magnetic Body

The magnetic body is exemplified, for example, by magnetite, γ-hematite, various kinds of ferrite, and the like.

The blending ratio of the magnetic body, with respect to 100 parts by mass of the binder resin, is, for example, not less than 10 parts by mass, preferably not less than 20 parts by mass; the blending ratio is, for example, not more than 500 parts by mass, preferably not more than 150 parts by mass. The magnetic body can also be used as the above-mentioned colorant.

2.2: External Additive

The external additive adjusts the electrostatic property, the fluidity, the storage stability of the toner particles. The external additive is exemplified, for example, by inorganic particles, synthetic resin particles, etc.

The inorganic particles are exemplified, for example, by silica, aluminum oxide, titanium oxide, oxide of silicon and aluminum, oxide of silicon and titanium, a hydrophobized product thereof, etc. For example, hydrophobized silica can be obtained by processing silica fine powders with silicone oil or a silane coupling agent such as, for example, dichlorodimethylsilane, hexamethyldisilazane, tetramethyldisilazane.

The synthetic resin particles are exemplified, for example, by methacrylic acid ester polymer particles, acrylic acid ester polymer particles, styrene/methacrylate copolymer particles, styrene-acrylate copolymer particles, core shell-type particles having a core of styrene polymer and a shell of methacrylate polymer, etc.

The particle size of the external additive is smaller than the particle size of the toner particles. The particle size of the external additive is, for example, not more than 2 μm, is preferably not more than 0.1 μm, and is more preferably not more than 0.03 μm.

The blending ratio of the external additive, with respect to 100 parts by mass of the toner particles, is, for example, not less than 0.1 parts by mass; the blending ratio is, for example, not more than 10 parts by mass.

2.3: Method for Producing Toner

In order to produce the toner, firstly, the toner particles are produced. The method for producing the toner particles is exemplified, for example, by the kneading/pulverizing method, the suspension/polymerization method, the emulsion polymerization/coagulation method, the emulsion/astringent method, the injection granulation method, etc.

In order to produce the toner particles, the binder resin, the electrostatic charge controlling agent, the colorant are mixed and a resulting mixture is melted and kneaded by a twin screw extruder. Next, a resulting kneaded matter is cooled and then is milled. Thus, the toner particles can be obtained.

Next, in order to prepare the toner, the external additive is then added to and mixed with the obtained toner particles. Thus, the toner can be obtained. The particle size of the toner is, in the median diameter, for example, not less than 3 μm, preferably not less than 5 μm; the particle size of the toner is, for example, not more than 12 μm, is preferably not more than 9 μm.

3. Fixing Solution

The fixing solution contains the ester-based softening agent. The fixing solution contains a diluent and a surfactant, as necessary.

3.1: Ester-Based Softening Agent

The ester-based softening agent is capable of softening the binder resin. The boiling point of the ester-based softening agent at 1 atmosphere is, for example, not less than 180° C., is preferably not less than 250° C.; the boiling point of the ester-based softening agent at 1 atmosphere is, for example, not more than 400° C., or not more than 310° C. Namely, the ester-based softening agent is less likely to evaporate in an environment in which the image forming apparatus 1 described above is used. Therefore, it is possible to suppress the occurrence of any strong odor of the organic solvent.

The ester-based softening agent is exemplified, for example, by aliphatic carboxylic acid ester, carbonic ester, etc.

The aliphatic carboxylic acid ester is exemplified by aliphatic monocarboxylic acid ester represented by, for example, the following chemical formula (1). Further, the aliphatic carboxylic acid ester is exemplified by aliphatic dicarboxylic acid ester such as aliphatic dicarboxylic acid dialkyl represented by, for example, the following chemical formula (2); and aliphatic dicarboxylic acid dialkoxyalkyl represented by, for example, the following chemical formula (3).

R1-COO—R2 Chemical Formula (1):

(each of R1 and R2 is a straight chain or branched alkyl group; R1 and R2 may be different from each other or same. Note that it is preferred that R1 is a straight chain or branched alkyl group having carbon atoms of which number is in a range of not less than 9 to not more than 15; and that R2 is a straight chain or branched alkyl group having carbon atom(s) of which number is in a range of not less than 1 to not more than 4).

$R3(-COO—R4)_2$ Chemical Formula (2):

(R3 is a straight chain or branched alkylene group: R4 is a straight chain or branched alkyl group; two pieces of R4 may be different from each other or same; note that it is preferred that R3 is a straight chain or branched alkylene group having carbon atoms of which number is in a range of not less than 2 to not more than 10; and that R4 is a straight chain or branched alkyl group having carbon atom(s) of which number is in a range of not less than 1 to not more than 8).

$R5(-COO—R6-O—R7)_2$ Chemical Formula (3):

(R5 or R6 is a straight chain or branched alkylene group. R7 is a straight chain or branched alkyl group. Note that it is preferred that R5 is a straight chain or branched alkylene group having carbon atoms of which number is in a range of not less than 2 to not more than 10, that R6 is a straight chain or branched alkylene group having carbon atoms of which number is in a range of not less than 2 to not more than 4, and that R7 is a straight chain or branched alkyl group having carbon atom(s) of which number is in a range of not less than 1 to not more than 4).

The aliphatic monocarboxylic acid ester is exemplified, for example, by ethyl decanoate (boiling point: 243° C.), ethyl laurate (boiling point: 275° C.), ethyl palmitate (boiling point: 330° C.), and the like.

The aliphatic dicarboxylic acid dialkyl is exemplified, for example, by: diethyl succinate (boiling point: 196° C.), diethyl adipate (boiling point: 251° C.), diisobutyl adipate (boiling point: 293° C.), dioctyl adipate (boiling point: 335° C.), diethyl sebacate (boiling point: 309° C.), dibutyl sebacate (boiling point: 345° C.), dioctyl sebacate (boiling point: 377° C.), and diethyl dodecanedioate (boiling point: 200° C.), and the like.

The aliphatic dicarboxylic acid dialkoxyalkyl is exemplified, for example, by: diethoxyethyl succinate (boiling point: not less than 200° C.), dibutoxyethyl succinate (boiling point: not less than 200° C.), diethoxyethyl adipate (boiling point: not less than 200° C.), diethoxy ethoxy ethyl succinate (boiling point: not less than 200° C.), and the like.

The carbonic ester is exemplified, for example, by: ethylene carbonate (boiling point: 261° C.), propylene carbonate (boiling point: 242° C.), and the like.

The ester-based softening agent is preferably dibasic ester such as aliphatic dicarboxylic acid ester, carbonic ester, etc. More preferably, the ester-based softening agent is the aliphatic dicarboxylic acid ester. The aliphatic dicarboxylic acid ester is, for example, diethyl sebacate, diethoxyethyl succinate, diisobutyl adipate, diethyl dodecanedioate. In a case that the ester-based softener is the aliphatic dicarboxylic acid ester, it is possible to suppress any transfer of the toner on another print medium in such a case that the another print medium is overlaid on the print medium on which the toner image is formed and to which the fixing liquid is applied. Only one kind of these ester-based softening agents may be used singly, or two or more kinds of these ester-based softening agents may be used in a mixed manner.

The blending ratio, in the fixing solution, of the ester-based softening agent is, for example, not less than 5% by mass, not less than 50% by mass, not less than 90% by mass, or not less than 95% by mass; the blending ratio is, for example, not more than 100% by mass, and is, for example, 100% by mass. The fixing solution may be composed substantially only of the ester-based softening agent. Alternatively, the fixing solution may be composed by further mixing another substance in the ester-based softening agent. In a case that the ester-based softening agent and another substance are combined so as to compose the fixing solution, the blending ratio of the ester-based softening agent, in the fixing solution, is, for example, not less than 1% by mass, preferably not less than 20% by mass.

3.2: Diluent

The diluent is a solvent for diluting the ester-based softening agent. The ester-based softening agent may be diluted by being dispersed in the diluent. Further, the ester-based softening agent may also be diluted by dispersing the diluent in the ester-based softening agent. Furthermore, the ester-based softening agent may also be diluted by being dissolved in the diluent.

The diluent is exemplified, for example, by water; by, for example, a monohydric or polyhydric alcohol-based solvent; n-alkane; iso-paraffine; silicone oil; and the like. The monohydric or polyhydric alcohol-based solvent is exemplified, for example, by ethanol, propylene glycol, glycerol, and the like.

3.3: Surfactant

The surfactant is blended in the fixing solution so as to disperse the ester-based softening agent in the diluent. Alternatively, the surfactant is blended in the fixing solution so as to disperse the diluent in the ester-based softening agent.

The surfactant is exemplified, for example, by: an anionic surfactant such as alkylbenzene sulfonates, aliphatic sulfonates, etc.; a cationic surfactant such as aliphatic amine salts, aliphatic quaternary ammonium salts, etc.; and a nonionic surfactant such as polyoxyethylene alkyl ether, etc.

The blending ratio, in the fixing solution, of the surfactant is, for example, not less than 0.1% by mass, for example, not more than 30% by mass.

4. Set Usable for Image Forming Method

A set usable for the image forming method related to the present embodiment includes: a toner, and a fixing solution. The toner contains toner particles containing a binder resin which contains a condensate of straight chain diol having 2 to 6 carbon atoms, alkylene oxide adduct of bisphenol A and polyvalent carboxylic acid. The fixing solution contains an ester-based softening agent of which boiling point is not less than 180° C.

The toner and the fixing solution included in the set usable in the image forming method is similar to the toner and the fixing solution used in the image forming method and the image forming apparatus as described above, and the explanation thereof can be incorporated herein by reference.

5. Effects

According to the image forming method and the image forming apparatus 1, the binder resin is softened with the ester-based softening agent of which boiling point is not less than 180° C.

Therefore, it is possible to suppress any volatilization of the organic solvent and to suppress any generation of the strong odor of the organic solvent.

Further, the binder resin also contains the condensate of the straight chain diol having 2 to 6 carbon atoms, the alkylene oxide adduct of bisphenol A and the polyvalent carboxylic acid.

Therefore, the binder resin is softened with the ester-based softening agent of which boiling point is not less than 180° C., and is cured in a state that the binder resin contains the ester-based softening agent.

As a result, even in a case that the toner image is formed on a certain print medium and the fixing solution is applied to the certain print medium, and that another print medium is overlaid on the certain print medium, it is possible to suppress any transfer of the toner onto the another print medium.

According to the image forming method of this embodiment, it is possible to form a toner image on a print medium while suppressing the generation of the strong odor of the organic solvent, and to suppress any transfer of the toner on another print medium in a case that the another print medium is overlaid on the print medium on which the toner image is formed and to which the fixing solution is added.

6. Modifications

The development system of the above-described embodiment is the one-component development system using only the magnetic or non-magnetic toner, but the present teaching is not limited to or restricted by the above-described embodiment.

The developing system may be, for example, the two-component development system in which a toner and a carrier are mixed. In a case that the developer is the two-component developer, the carrier is exemplified, for example, by an alloy of a metal such as iron, ferrite, magnetite, etc., and a metal such as aluminum, lead, etc.

The carrier particle size is, for example, not less than 4 μm, preferably not less than 20 μm; the carrier particle size is, for example, not more than 200 μm, preferably not more than 150 μm.

The blending ratio of toner, with respect to 100 parts by mass of the carrier, is, for example, not less than 1 part by mass, preferably is 2 parts by mass; the blending ratio is, for example, not more than 200 parts by mass, preferably not more than 50 parts by mass.

The carrier may be a resin-coated carrier, a dispersion type carrier in which the magnetic powder is dispersed in the binder resin, etc.

EXAMPLES

Next, the present teaching will be explained based on Examples and Comparative Examples. Note that, however, the present teaching is not limited by or restricted to the following examples.

1. Production of Binder Resin

For each of the examples (Examples 1 to 9), straight chain diol, branched diols, terephthalic acid, and tin(II) 2-ethylhexanoate as the esterification catalyst, indicated in any of TABLES 1 to 4, were charged to a reactor vessel (four-necked flask of 5 L). Note that the reactor vessel was equipped with a thermometer, a stainless-steel stirring rod, a rectifying column allowing hot water passing therethrough, a downflow condenser and a nitrogen introducing tube.

Then, under the nitrogen atmosphere, the temperature was raised to 180° C. in the inside of a mantle heater, and then was raised to 230° C. for 8 (eight) hours.

Afterwards, trimellitic anhydride was charged into the reactor vessel and heated at 220° C., while reducing the pressure in the reactor vessel to 8.0 kPa. Thus, the binder resin was obtained.

2. Production of Toner

With respect to 100 parts by mass of the obtained binder resin, 3 parts by mass of BONTRON N-04 (electrostatic charge controlling agent, manufactured by ORIENT CHEMICAL INDUSTRIES CO., LTD.), 7 parts by mass of FCA-F201-PS (electrostatic charge controlling agent, manufactured by FUJIKURA CHEMICAL Co.), and 6 parts by mass of REGAL 330R (colorant, carbon black; manufactured by CABOT SPECIALTY CHEMICALS, INC.) were mixed by using a Henschel mixer.

Next, the obtained mixture was melted and kneaded by a twin screw extruder.

Next, the obtained the kneaded matter was cooled and ground to about 1 mm by using a hammer mill.

Next, the obtained pulverized (ground) product was then further milled with a pulverizer (crusher) of the air-jet system.

Next, the obtained pulverized (ground) product was then classified so as to obtain toner particles with a volume median diameter (D50) of 7.5 μm.

Next, 0.5 parts by mass of NAX-50 (external additive, hydrophobic silica; manufactured by AEROSIL JAPAN) and 0.5 parts by mass of RX-300 (external additive, hydrophobic silica; manufactured by NIPPON AEROSIL CO., LTD.) were added and mixed to 100 parts by mass of the obtained toner particles, by using the Henschel mixer.

Thus, the toner was obtained.

3. Evaluations 3.1: Preparation of Sample

The obtained toner was filled into a developing cartridge and a toner image of which toner adhesion amount was 5 $g/m^2$ was formed on one side of a sheet (paper, paper sheet) by using an image forming apparatus "HL-L2360D" (manufactured by BROTHER INDUSTRIES, LTD.) from which a thermal fixing device was removed. Since the thermal fixing device was removed, the toner image was not fixed to the sheet.

Figure 2:
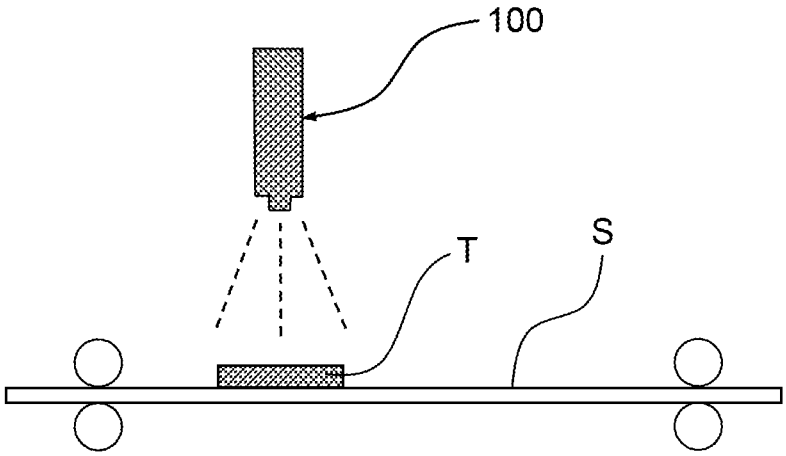
FIG. 2 is a schematic view of an off-line fixing device usable for evaluating the fixing property.

Next, an off-line fixing device having an atomizer 100 as depicted in FIG. 2 mounted thereon was used so as to spray a fixing solution indicated in any of Tables 1 to 4, to a toner image T with an atomization amount of 0.2 g of the fixing solution per A4 size. Note that the atomizer 100 is an air brush which sprays the fixing solution by using compressed air.

Next, the sheet on which the toner image was formed was then left to stand in a thermostatic bath for a predetermined time (1 hour or 24 hours), at the temperature of 25° C. and the humidity of 30%. Thus, a sample was obtained.

3.2: Evaluation of Fixing Property

Two piece of the above-described sample (two samples) were prepared; the two samples were overlaid so that a part, of the other of the two samples, in which any toner image was not formed is overlaid on or placed on the toner image on one of the two sample; and a weight was placed on the two overlaid samples such that a 150 g/cm$^2$ load was applied on the two overlaid samples.

Then, in a state that the weight was placed on the two samples, the two samples were left to stand in the thermostatic bath at the temperature of 25° C. and the humidity of 30% for 24 hours.

Afterwards, the other of the two samples was removed or stripped from the one of the two samples and any transfer of the toner between the one and the other of the two samples, and any deficiency of the toner image accompanying with the transfer of the toner were visually evaluated. In a case that the transfer of the toner and the deficiency of the toner image were smaller, the fixing property of toner to the sheet was evaluated to be more satisfactory. The evaluation criterion is indicated below.

Note that in the following evaluation criterion, "A" is the most excellent in the fixing property, and "E" is the least excellent in fixing property. In addition, "F" and "G" are each treated as being inferior to "E", and the fixing evaluation was not performed therefor. In the following evaluation criterion, "A" to "C" are of the practically problem-free level.

<Evaluation Criterion>

A: Any transfer of the toner and any deficiency of the toner image were not observed at all.

B: A slight transfer of the toner was observed, but not to such an extent that there was any deficient of the toner image.

C: The two samples were weakly adhered to each other by the toner, and a transfer of the toner, to such an extent that the toner image was slightly deficient, was observed.

D: The two samples were strongly adhered to each other by the toner, and a transfer of the toner, to such an extent that the toner image had a large number of a deficit part (blank (void, a white patch on a printed sheet) were generated in the toner image, was observed.

E: The two samples were strongly adhered to each other by the toner to such an extent that the two samples were difficult to peel off from each other. In a case that the two samples were peeled off forcibly, a part of the sheet having the toner image formed therein was damaged or broken.

F: After one hour since the application of the fixing solution, toner was not fixed to the sheet.

G: After the fixing solution was applied, there was any unpleasant smell (strong odor of the organic solvent).

In the following TABLES 1 to 4, the binding resin composition is indicated by the molar ratio. Further, in TABLES 1 to 4, BPA-EO is an ethylene oxide adduct of bisphenol A (addition molar number of ethylene oxide: 2 to 4), BPA-PO is an propylene oxide adduct of bisphenol A (addition molar number of propylene oxide: 2 to 4), and BPA-EO+BPA-PO is a mixture having the molar ratio of (BPA-EO):(BPA-PO)=30:70.

TABLE 1

| | | | EXAMPLES | | | |
|---|---|---|---|---|---|---|
| | | | 1 | 2 | 3 | 4 |
| Binding Resin Composition | Straight chain diol | 1,4-butanediol | 50 | 50 | 50 | 50 |
| | | 1,2-ethanediol | — | — | — | — |
| | | 1,3-propanediol | — | — | — | — |
| | | 1,6-hexanediol | — | — | — | — |
| | Branched diol | BPA-EO | 50 | 50 | 50 | 50 |
| | | 2,2-dimethyl-1,3-propane diol | — | — | — | — |
| | | BPA-EO + BPA-PO | — | — | — | — |
| | Polyvalent carboxylic acid | Terephthalic acid | 90 | 90 | 90 | 90 |
| | | Trimellitic anhydride | — | — | — | — |

| | Ester-based softening agent | | Boiling point (° C.) | Ratio of ester-based softening agent (% by mass) | | | |
|---|---|---|---|---|---|---|---|
| Fixing Solution | Aliphatic dicarboxylic acid ester | Diethyl sebacate | 309 | 100 | — | — | — |
| | | Diethoxyethyl succinate | >200 | — | 100 | — | — |
| | | Diisobutyl adipate | 293 | — | — | 100 | — |
| | | Diethyl dodecanedioate | >200 | — | — | — | 100 |
| | | Diethyl succinate | 196 | — | — | — | — |
| | | Dibutyl sebacate | 345 | — | — | — | — |
| | Aliphatic mono-carboxylic acid ester | Ethyl Laurate | 275 | — | — | — | — |
| | | Ethyl decanoate | 243 | — | — | — | — |
| | | Ethyl acetate | 77 | — | — | — | — |
| | Carbonic ester | Propylene carbonate | 242 | — | — | — | — |
| | Glycol | Tripropylene glycol | 273 | — | — | — | — |
| | Hydrocarbon | Hexadecane | 287 | — | — | — | — |
| Evaluation | | 1 hour later | | B | B | B | B |
| | | 24 hours later | | A | A | A | A |

* BPA-EO is an ethylene oxide adduct of bisphenol A.

* BPA-EO + BPA-PO is a mixture of an ethylene oxide adduct of bisphenol A and a propylene oxide adduct of bisphenol A.

TABLE 2

| | | | EXAMPLES | | | | |
|---|---|---|---|---|---|---|---|
| | | | 5 | 6 | 7 | 8 | 9 |
| Binding Resin Composition | Straight chain diol | 1,4-butanediol | 50 | 50 | — | — | — |
| | | 1,2-ethanediol | — | — | 50 | — | — |
| | | 1,3-propanediol | — | — | — | 50 | — |
| | | 1,6-hexanediol | — | — | — | — | 50 |
| | Branched diol | BPA-EO | 50 | 50 | 50 | 50 | 50 |
| | | 2,2-dimethyl-1,3-propane diol | — | — | — | — | — |
| | | BPA-EO + BPA-PO | — | — | — | — | — |
| | Polyvalent carboxylic acid | Terephthalic acid | 90 | 90 | 85 | 85 | 85 |
| | | Trimellitic anhydride | — | — | 2 | 5 | 5 |
| Ester-based softening agent | | | Boiling point (° C.) | Ratio of ester-based softening agent (% by mass) | | | |
| Fixing Solution | Aliphatic dicarboxylic acid ester | Diethyl sebacate | 309 | — | — | — | — | — |
| | | Diethoxyethyl succinate | >200 | — | — | — | — | — |
| | | Diisobutyl adipate | 293 | — | — | — | — | — |
| | | Diethyl dodecanedioate | >200 | — | — | — | — | — |
| | | Diethyl succinate | 196 | — | — | 100 | — | — |
| | | Dibutyl sebacate | 345 | — | — | — | 100 | — |
| | Aliphatic mono-carboxylic acid ester | Ethyl Laurate | 275 | — | 100 | — | — | — |
| | | Ethyl decanoate | 243 | — | — | — | — | 100 |
| | | Ethyl acetate | 77 | — | — | — | — | — |
| | Carbonic ester | Propylene carbonate | 242 | 100 | — | — | — | — |
| | Glycol | Tripropylene glycol | 273 | — | — | — | — | — |
| | Hydrocarbon | Hexadecane | 287 | — | — | — | — | — |
| Evaluation | | 1 hour later | | C | C | C | C | C |
| | | 24 hours later | | B | B | C | C | C |

35

TABLE 3

| | | | COMPARATIVE EXAMPLES | | | |
|---|---|---|---|---|---|---|
| | | | 1 | 2 | 3 | 4 |
| Binding Resin Composition | Straight chain diol | 1,4-butanediol | — | 100 | — | — |
| | | 1,2-ethanediol | — | — | — | 50 |
| | | 1,3-propanediol | — | — | — | — |
| | | 1,6-hexanediol | — | — | — | — |
| | Branched diol | BPA-EO | 100 | — | — | — |
| | | 2,2-dimethyl-1,3-propane diol | — | — | — | 50 |
| | | BPA-EO + BPA-PO | — | — | 100 | — |
| | Polyvalent carboxylic acid | Terephthalic acid | 80 | 80 | 60 | 80 |
| | | Trimellitic anhydride | 2 | 2 | 25 | 5 |
| Ester-based softening agent | | | Boiling point (° C.) | Ratio of ester-based softening agent (% by mass) | | |
| Fixing Solution | Aliphatic dicarboxylic acid ester | Diethyl sebacate | 309 | 100 | 100 | 100 | — |
| | | Diethoxyethyl succinate | >200 | — | — | — | 100 |
| | | Diisobutyl adipate | 293 | — | — | — | — |
| | | Diethyl dodecanedioate | >200 | — | — | — | — |
| | | Diethyl succinate | 196 | — | — | — | — |
| | | Dibutyl sebacate | 345 | — | — | — | — |
| | Aliphatic mono-carboxylic acid ester | Ethyl Laurate | 275 | — | — | — | — |
| | | Ethyl decanoate | 243 | — | — | — | — |
| | | Ethyl acetate | 77 | — | — | — | — |

TABLE 3-continued

| | | | | | | |
|---|---|---|---|---|---|---|
| Carbonic ester | Propylene carbonate | 242 | — | — | — | — |
| Glycol | Tripropylene glycol | 273 | — | — | — | — |
| Hydrocarbon | Hexadecane | 287 | — | — | — | — |
| Evaluation | 1 hour later | | E | F | E | E |
| | 24 hours later | | E | F | E | D |

TABLE 4

| | | | | COMPARATIVE EXAMPLES | | |
|---|---|---|---|---|---|---|
| | | | | 5 | 6 | 7 |
| Binding Resin Composition | Straight chain diol | 1,4-butanediol | | 50 | 50 | 50 |
| | | 1,2-ethanediol | | — | — | — |
| | | 1,3-propanediol | | — | — | — |
| | | 1,6-hexanediol | | — | — | — |
| | Branched diol | BPA-EO | | 50 | 50 | 50 |
| | | 2,2-dimethyl-1,3-propane diol | | — | — | — |
| | | BPA-EO + BPA-PO | | — | — | — |
| | Polyvalent carboxylic acid | Terephthalic acid | | 90 | 90 | 90 |
| | | Trimellitic anhydride | | — | — | — |
| Ester-based softening agent | | | Boiling point (° C.) | Ratio of ester-based softening agent (% by mass) | | |
| Fixing Solution | Aliphatic dicarboxylic acid ester | Diethyl sebacate | 309 | — | — | — |
| | | Diethoxyethyl succinate | >200 | — | — | — |
| | | Diisobutyl adipate | 293 | — | — | — |
| | | Diethyl dodecanedioate | >200 | — | — | — |
| | | Diethyl succinate | 196 | — | — | — |
| | | Dibutyl sebacate | 345 | — | — | — |
| | Aliphatic mono-carboxylic acid ester | Ethyl Laurate | 275 | — | — | — |
| | | Ethyl decanoate | 243 | — | — | — |
| | | Ethyl acetate | 77 | 100 | — | — |
| | Carbonic ester | Propylene carbonate | 242 | — | — | — |
| | Glycol | Tripropylene glycol | 273 | — | 100 | — |
| | Hydrocarbon | Hexadecane | 287 | — | — | 100 |
| Evaluation | | 1 hour later | | G | F | F |
| | | 24 hours later | | G | F | F |

As indicated in TABLE 1 and TABLE 2, Examples 1 to 9 had satisfactory fixing property (results of evaluation of fixing property: A to C). Further, the results of evaluation of fixing property of Examples 1 to 9 were not G. That is, in Examples 1 to 9, any strong odor of the organic solvent was not generated, as well.

Examples 1-6, in each of which binder resin was a condensate of 1,4-butanediol, ethylene oxide adduct of bisphenol A and terephthalic acid, had further satisfactory fixing property. In addition, Examples 1 to 4, in each of which the binder resin was the condensate of 1,4-butanediol, ethylene oxide adduct of bisphenol A and terephthalic acid, and the fixing solution contained any one of diethyl sebacate, diethoxyethyl succinate, diisobutyl adipate and diethyl dodecanedioate, had further more satisfactory fixing property.

On the other hand, as indicated in TABLES 3 and 4, Comparative Examples 1 to 7 had unsatisfactory results of the evaluation of the fixing property, as explained below. Comparative Examples 1 and 3 in each of which the binder resin was a condensate containing no straight chain diol having 2 to 6 carbon atoms, and Comparative Example 4 in which the binder resin was a condensate containing a branched diol, which is different from the alkylene oxide adduct of bisphenol A, rather than containing the alkylene oxide adduct of bisphenol A, had unsatisfactory results of evaluation of fixing property (results of evaluation of fixing property: D and E). Comparative Example 2, in which the binder resin was a condensate containing no alkylene oxide adduct of bisphenol A, the toner was not fixed to the sheet (result of evaluation of fixing property: F). Further, in Comparative Example 5 in which the fixing solution contained an ester having a boiling point of less than 180° C., a strong odor of the organic solvent was generated (result of evaluation of fixing property: G). In Comparative Example 6 in which the fixing solution contained glycol and in Comparative Example 7 in which the fixing solution contained hydrocarbon, rather than containing the ester-based softening agent of which boiling point was not less than 180° C., the toner was not fixed to the sheet (results of evaluation of fixing property: F).

What is claimed is:

1. An image forming method comprising:

forming a toner image on a print medium by using a toner including toner particles having a binder resin which contains a condensate of straight-chain diol having 2 to 6 carbon atoms, an alkylene oxide adduct of bisphenol A and polyvalent carboxylic acid; and applying, to the toner image, a fixing solution containing an ester-based softening agent having a boiling point of not less than 180° C. so as to fix the toner image to the print medium;

wherein the ester-based softening agent is contained in the fixing solution by not less than 90% by mass.

2. The image forming method according to claim 1, wherein the ester-based softening agent softens the binder resin in fixing of the toner image to the print medium.

3. The image forming method according to claim 1, wherein the straight chain diol having 2 to 6 carbon atoms is α,ω-aliphatic diol.

4. The image forming method according to claim 3, wherein the α,ω-aliphatic diol is at least one selected from the group consisting of: 1,2-ethanediol, 1,3-propanediol, 1,4-butanediol, 1,5-pentanediol and 1,6-hexanediol.

5. The image forming method according to claim 4, wherein the α,ω-aliphatic diol is the 1,4-butanediol.

6. The image forming method according to claim 1, wherein the ester-based softening agent of comprises a dibasic ester.

7. The image forming method according to claim 6, wherein the ester-based softening agent comprises an aliphatic dicarboxylic acid ester.

8. The image forming method according to claim 7, wherein the aliphatic dicarboxylic acid ester is at least one selected from the group consisting of: diethyl sebacate, diethoxyethyl succinate, diisobutyl adipate and diethyl dodecanedioate.

9. The image forming method according to claim 1, wherein the polyvalent carboxylic acid is aromatic dicarboxylic acid.

10. The image forming method according to claim 9, wherein the aromatic dicarboxylic acid is terephthalic acid.

11. The image forming method according to claim 1, wherein the alkylene oxide adduct of bisphenol A is at least one of an ethylene oxide adduct of bisphenol A and a propylene oxide adduct of bisphenol A.

12. The image forming method according to claim 11, wherein the alkylene oxide adduct of bisphenol A is the ethylene oxide adduct of bisphenol A.

13. The image forming method according to claim 1, wherein the binder resin is composed only of the condensate of the straight-chain diols having 2 to 6 carbon atoms, the alkylene oxide adduct of bisphenol A and the polyvalent carboxylic acid.

14. The image forming method according to claim 1, wherein a molar ratio of a molar number of the alkylene oxide adduct of bisphenol A to a molar number of the straight chain diol is in a range of 50/50 to 70/30.

15. The image forming method according to claim 1, wherein a molar ratio of a molar number of the polyvalent carboxylic acid to a combined molar number of the straight-chain diol and the alkylene oxide adduct of bisphenol A is in a range of 85/100 to 90/100.

16. The image forming method according to claim 1, wherein in fixing of the toner image to the print medium, the toner image is fixed to the print medium without adhering the toner image to the print medium through thermal pressurization.

17. The image forming method according to claim 1, wherein in fixing of the toner image to the print medium, the binder resin is softened with the ester-based softening agent having the boiling point of not less than 180° C. and is cured in a state that the binder resin contains the ester-based softening agent.

* * * * *